US008944075B2

(12) United States Patent
Holford et al.

(10) Patent No.: US 8,944,075 B2
(45) Date of Patent: Feb. 3, 2015

(54) SMOKING ARTICLE WRAPPER

(75) Inventors: Steven Holford, London (GB); Aaron McKenzie, London (GB)

(73) Assignee: British American Tobacco (Investments) Limited, London (GB)

( * ) Notice: Subject to any disclaimer, the term of this patent is extended or adjusted under 35 U.S.C. 154(b) by 0 days.

(21) Appl. No.: 14/119,056

(22) PCT Filed: May 10, 2012

(86) PCT No.: PCT/EP2012/058627

§ 371 (c)(1), (2), (4) Date: Feb. 10, 2014

(87) PCT Pub. No.: WO2012/159887

PCT Pub. Date: Nov. 29, 2012

(65) Prior Publication Data

US 2014/0190504 A1 Jul. 10, 2014

(30) Foreign Application Priority Data

May 20, 2011 (GB) ..... 1108475.3

(51) Int. Cl.
*A24D 1/02* (2006.01)
*D21H 27/02* (2006.01)

(52) U.S. Cl.
CPC . *A24D 1/027* (2013.01); *A24D 1/02* (2013.01)
USPC ..... 131/365; 131/331; 131/360; 162/109; 162/114; 162/117; 162/139

(58) Field of Classification Search
USPC ..... 131/331, 360, 365; 162/139, 100, 109, 162/117, 113, 114
See application file for complete search history.

(56) References Cited

U.S. PATENT DOCUMENTS

| | | | | | |
|---|---|---|---|---|---|
| 2,804,078 | A | * | 8/1957 | Saffir | 131/344 |
| 3,524,450 | A | * | 8/1970 | Molins et al. | 131/331 |
| 4,061,147 | A | | 12/1977 | Falchi | |
| 4,295,478 | A | | 10/1981 | Yeatts | |
| 4,302,654 | A | | 11/1981 | Bennett et al. | |
| 4,687,008 | A | * | 8/1987 | Houck et al. | 131/335 |
| 4,716,912 | A | * | 1/1988 | Leonard | 131/336 |
| 5,092,350 | A | | 3/1992 | Arthur et al. | |
| 2005/0000533 | A1 | | 1/2005 | Yamada et al. | |
| 2007/0169786 | A1 | | 7/2007 | Li et al. | |
| 2008/0314399 | A1 | * | 12/2008 | Ricketts et al. | 131/331 |

(Continued)

FOREIGN PATENT DOCUMENTS

| | | | |
|---|---|---|---|
| AT | 282451 | B | 6/1970 |
| CN | 101462204 | A | 6/2009 |

(Continued)

OTHER PUBLICATIONS

Definition of "crease", Merriam-Webster dictionary, no date, [online], [retrieved on Jun. 18, 2014].Retrieved from the Internet <URL:http://www.merriam-webster.com/dictionary/crease>.*

(Continued)

*Primary Examiner* — Dennis Cordray
(74) *Attorney, Agent, or Firm* — N W Poulsen; L A Pinol

(57) ABSTRACT

A smoking article such as a cigarette 1 has a wrapper in the form of a tube 5 that has lines of weakness 10 formed e.g. by laser cutting on the inside to define an array of visually discernable facets 12 on the outside.

22 Claims, 6 Drawing Sheets

(56) References Cited

U.S. PATENT DOCUMENTS

| | | | | |
|---|---|---|---|---|
| 2009/0320865 | A1 | 12/2009 | Ning | |
| 2011/0023901 | A1 | 2/2011 | Sherwood et al. | |
| 2013/0140197 | A1 * | 6/2013 | Fiebelkorn et al. | 206/205 |

FOREIGN PATENT DOCUMENTS

| | | | |
|---|---|---|---|
| CN | 201288274 | Y | 8/2009 |
| CN | 201288275 | Y | 8/2009 |
| CN | 101820782 | A | 9/2010 |
| CN | 101870038 | A | 10/2010 |
| DE | 202005020337 | U1 | 2/2006 |
| EP | 281686 | B1 | 9/1988 |
| EP | 0325921 | A1 | 8/1989 |
| EP | 502538 | B1 | 9/1992 |
| EP | 864014 | B1 | 9/1998 |
| EP | 1475003 | A1 | 11/2004 |
| EP | 1469999 | B1 | 6/2006 |
| EP | 2497382 | A1 * | 9/2012 |
| GB | 567797 | A | 3/1945 |
| GB | 678393 | A | 9/1952 |
| GB | 876796 | A | 9/1961 |
| GB | 2236042 | A | 3/1991 |
| GB | 2280589 | A | 2/1995 |
| WO | 9720107 | A1 | 6/1997 |
| WO | 2011042353 | A1 | 4/2011 |
| WO | 2011042354 | A1 | 4/2011 |
| WO | 2011121327 | A1 | 10/2011 |
| WO | WO 2011/121326 | A2 * | 10/2011 |

OTHER PUBLICATIONS

Definition of "facet", Merriam-Webster dictionary, no date, [online], [retrieved on Jun. 18, 2014].Retrieved from the Internet <URL:http://www.merriam-webster.com/dictionary/facet>.*

Definition of "score", Merriam-Webster dictionary, no date, [online], [retrieved on Jun. 18, 2014].Retrieved from the Internet <URL:http://www.merriam-webster.com/dictionary/score>.*

Definition of "array", Merriam-Webster dictionary, no date, [online], [retrieved on Jun. 18, 2014].Retrieved from the Internet <URL:http://www.merriam-webster.com/dictionary/array>.*

International Search Report and Written Opinion, mailed Sep. 28, 2012, for PCT/EP2012/058627, filed May 10, 2012.

Written Opinion, mailed Apr. 23, 2013, for PCT/EP2012/058627, filed May 10, 2012.

International Preliminary Report on Patentability, mailed Aug. 5, 2013, for PCT/EP2012/058627, filed May 10, 2012.

* cited by examiner

SMOKING ARTICLE WRAPPER

FIELD

This specification relates to a smoking article wrapper that can be used in a smoking article such as a cigarette.

BACKGROUND

Smoking articles such as filter cigarettes generally have a smooth paper wrapper around their outside. A typical cigarette structure comprises a rod of tobacco or like smokeable material wrapped in a smooth paper wrapper, attached to the filter by a tipping paper.

Proposals have been made to emboss the wrapper to control its porosity to admit ventilation air into the rod, as described in WO2011042353A1.

The provision of a distinctive visual effect on the exterior of a cigarette is described in WO2011042354A1, in which an outer wrapper is embossed by embossing rollers to provide ridges with different colours on opposite sides so that the colour changes from different angles of view.

SUMMARY

Embodiments of the present invention described herein provide a smoking article component including a curved sheet wrapper that includes a plurality of lines of strength discontinuity such that the wrapper presents visually discernable facets between the lines.

The embodiments also include a smoking article including the component and a wrapper for use in the smoking article.

The lines of strength discontinuity may comprise lines of weakness such as partial cuts into the thickness of the sheet material, which may comprise paper or the like.

The partial cuts can be on the side of the sheet material that faces inwardly, with the facets being visible on the exterior surface and when wrapped around a curved surface, the facets may have a different curvature from that of the curved surface.

The partial cuts may be formed by laser cutting and the lines of weakness may intersect or merge to define facets having a closed shape.

The facets may be arrayed over the sheet wrapper. A first array of facets of a first shape can be arranged in a first array in a first portion of the wrapper and a second array of facets of a second different shape from the first facets may be arranged in a second array in a second portion of the wrapper.

One or more opposite edges of the wrapper may have a shape defined by the edges of the facets so that when provided around the curved surface, the opposite edges of the sheet can form a joint such that the array extends across the joint.

A smoking article according to the invention may include a rod of smokeable material, a first filter attached to the rod, a second filter, the wrapper being wrapped around and attached to the second filter to form a tube in which the first filter and rod are slidably received.

Also disclosed is a method of making smoking article including wrapping a sheet wrapper around the article, the wrapper including a plurality of lines of strength discontinuity such that the wrapper bends so as to present visually discernable facets between the lines.

BRIEF DESCRIPTION OF THE DRAWINGS

In order that the invention may be more fully understood embodiments thereof will now be described by way of illustrative example with reference to the accompanying drawings in which.

DETAILED DESCRIPTION

Figure 1:
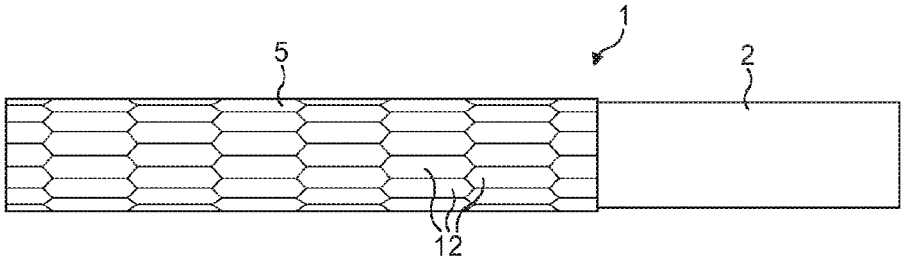
FIG. 1 is a side view of a smoking article comprising an extendible cigarette in an unextended configuration.
Figure 2A:
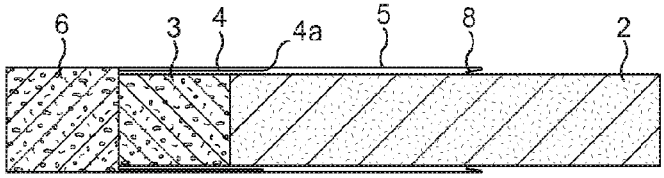
FIGS. 2*a* and 2*b* are longitudinal sectional views of the cigarette shown in FIG. 1 in unextended and extended configurations respectively.
Figure 2B:
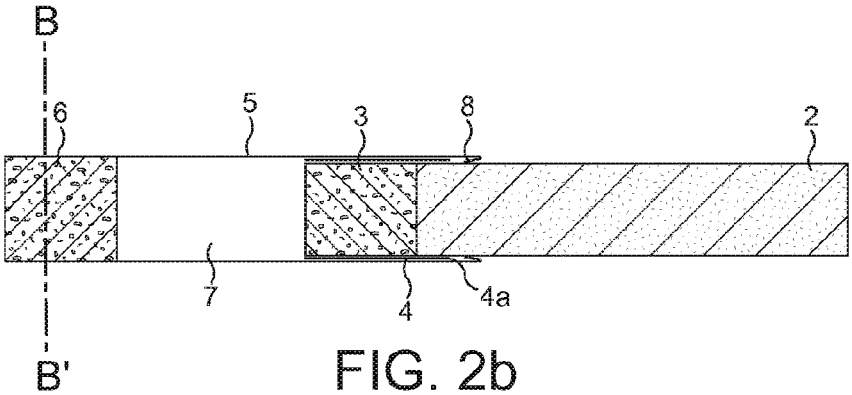

Referring to FIGS. 1 and 2, an extendable smoking article in the form of cigarette 1 comprises a tobacco rod 2 that as well known in the art comprises tobacco in a paper wrapper, with an attached first filter section 3. The tobacco rod 2 and the first filter section 3 are attached to one another by a covering layer of sheet material e.g. paper, preferably tipping paper 4 as illustrated in FIG. 2.

A first component part comprises a sleeve 5 in the form of a cylindrical tube that extends around the circumference of the tobacco rod 2 and the first filter section 3. The tobacco rod 2 and the first filter section 3 are dimensioned to slide as a unit longitudinally within the sleeve 5. The tobacco rod 2 and first filter section 3 may be referred to as a tobacco unit or as a second part of the smoking article 1.

The first part may further comprise a second filter section 6 at a mouth piece end of sleeve 5, distal from the first filter section 3. The second filter section is securely attached within the sleeve 5. The first and second filter sections 3,6 may be circular in cross section and of the same diameter and conveniently be made of conventional cellulose acetate tow with a plug wrap.

A chamber 7 is defined in the sleeve between the first and second filter sections 3, 6. The chamber 7 is of variable length and hence volume as the first filter section slides axially within the sleeve 5.

Relative movement of the first and second parts i.e. between the sleeve 5 and tobacco rod 2, beyond the maximum length is prevented by a re-entrant lip 8 formed at the distal end of the sleeve 5, which abuts a ridge on the tobacco rod 2 formed by the edge 4*a* of the tipping paper 4.

Figure 3:
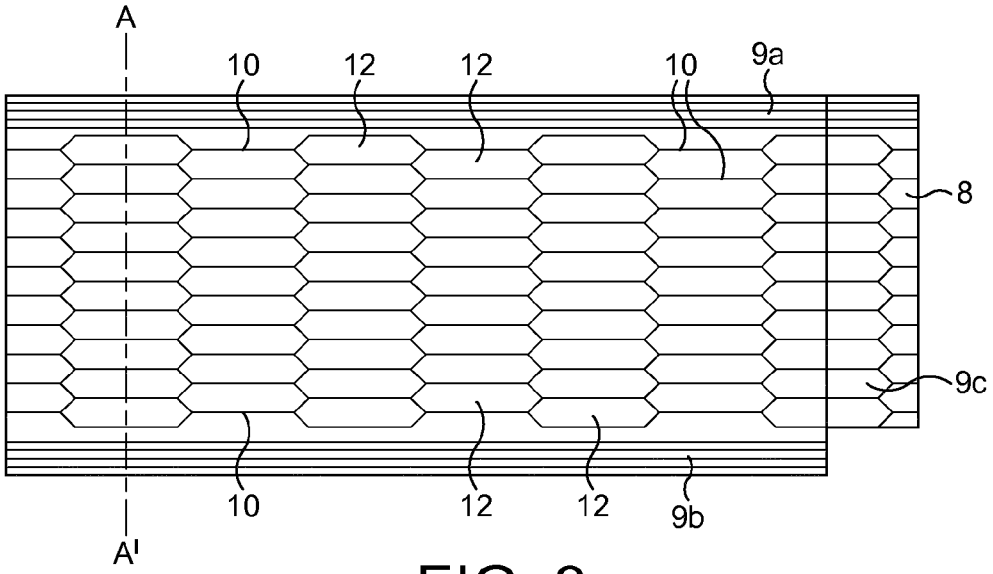
FIG. 3 is a plan view of the inside surface of the wrapper used in the cigarette shown in FIGS. 1 and 2.

As shown in FIG. 1, the exterior surface of the tubular sleeve 5 presents an array of facets which on the exterior are generally planar or at least of a different radius of curvature from that of the sleeve 5. The shape of the facets can be selected to achieve different visual effects and one example is illustrated in more detail in FIG. 3, which shows a blank 9 of sheet material that can be rolled up to form the tubular sleeve 5 around the second filter section 6. The tube 5 may be formed by gluing peripheral edges 9*a*, 9*b* to one another in an overlapping joint. Also, the re-entrant flap 8 can be created by folding region 9*c* of the blank inwardly.

The blank 9 includes a plurality of lines of strength discontinuity, in this example, lines of weakness 10, on the side of the blank 9 that forms the interior of tubular sleeve 5.

Figure 4:
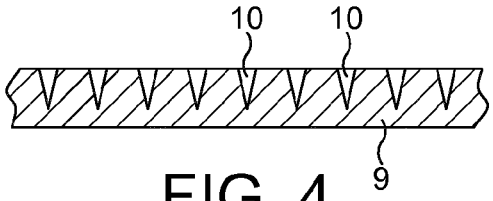
FIG. 4 is a partial sectional view through the thickness of the wrapper shown in FIG. 3 taken along line A-A'.

As illustrated in FIG. 4, the lines of weakness 10 may be formed by partially cutting into the sheet material that forms the blank 9. The cutting may conveniently be performed by laser cutting with one or more laser cutters which oscillate over the surface of the sheet material that forms blank 9. The depth of the cuts may be typically 50% of the thickness of the sheet material although the invention is not restricted to this depth. Preferably, the depth of the cutting comprises between 10-90% of the thickness of the blank. It will also be appreciated that the cutting can be performed using knife blades or the lines of weakness can be formed by creasing the sheet material or by pinching the sheet material from both sides.

Figure 5:
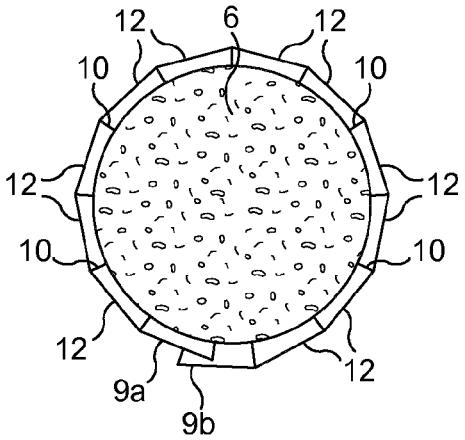
FIG. 5 is an enlarged sectional view of the wrapper taken along the line B-B' of FIG. 2*b*, when formed into a tube.
Figure 6:
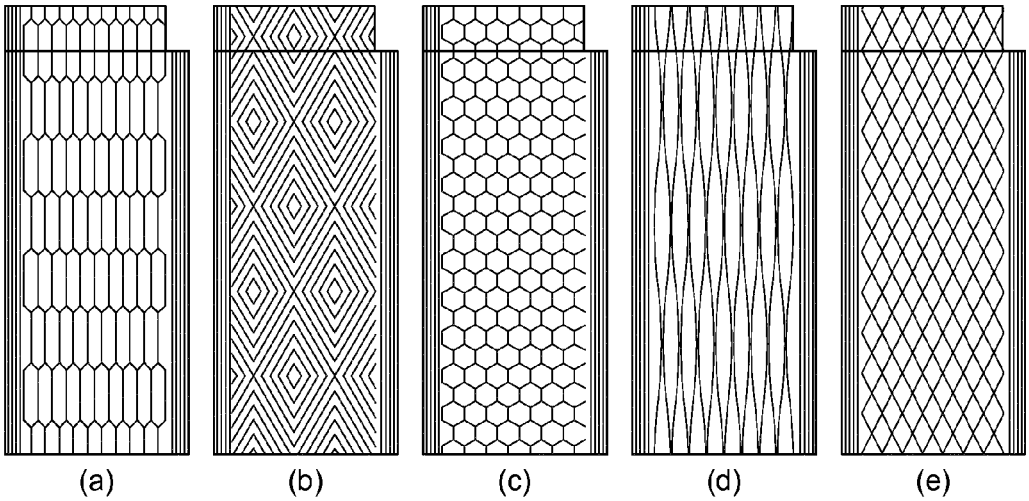
FIGS. 6*a*-6*e* illustrate alternative patterned blanks for use as the wrapper with different facet designs that extend in an array over the entire blank.
Figure 7:
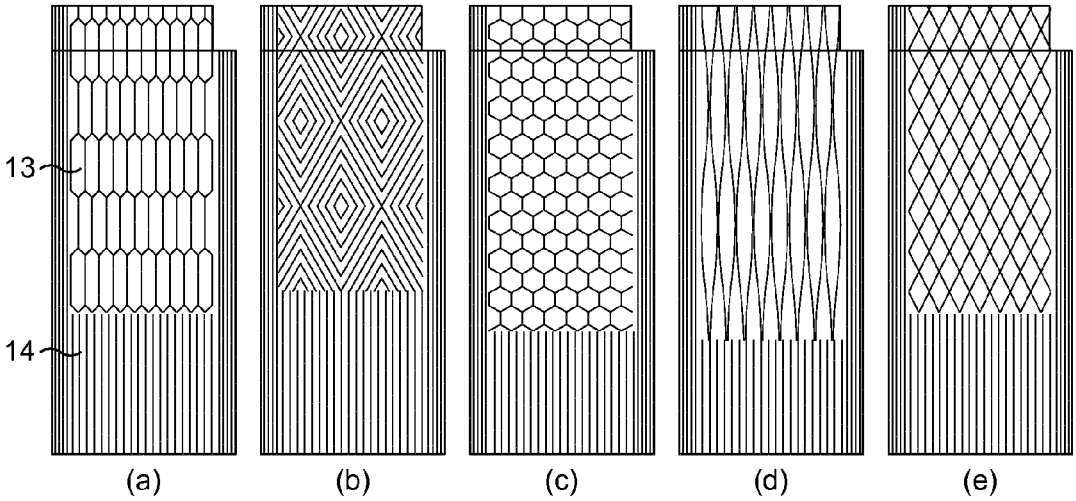
FIGS. 7*a*-7*e* illustrate alternative patterned blanks for use as the wrapper with first and second arrays of facets in different regions of the blanks.
Figure 8:
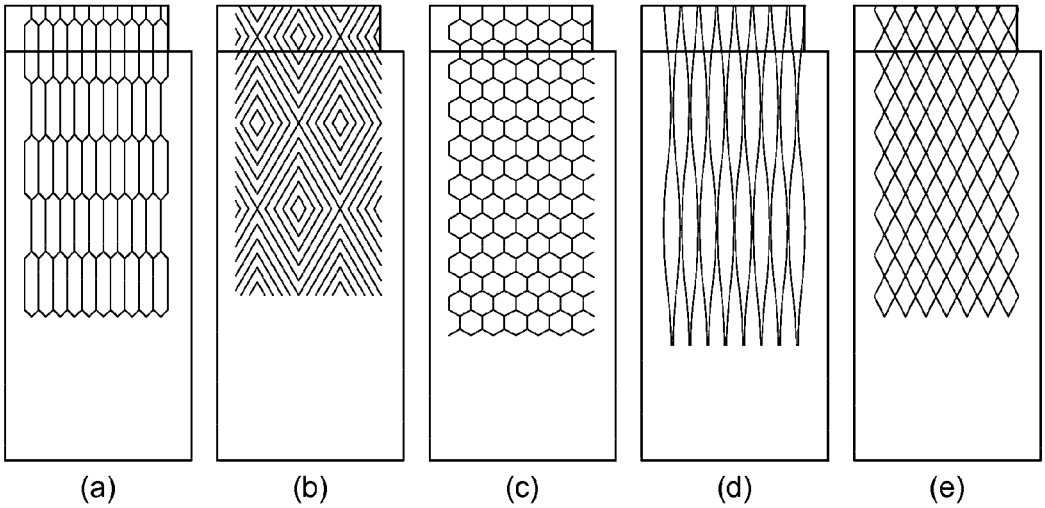
FIGS. 8*a*-8*e* illustrate alternative patterned blanks for use as the wrapper with an array of facets over only a part of the blanks.

As illustrated in FIG. 5, upon formation of the tubular sleeve 5, with the blank 9 being wrapped around the cylindrical surfaces of the first and second filter units 3, 6, the wrapping process results in the slits 10 becoming closed so that the inner surface 11 conforms to the curvature of the cylindrical filter elements 3, 6, which are of the same diameter, whereas the outer surface of sleeve 5 comprises a series of facets 12 that are generally planar or at least have the radius of curvature different from that of the curvature of the inner surface 5*a*. This gives rise to an array of visually discernable facets 12 illustrated in FIG. 1. It will be appreciated that the shape of the facets 5*b* can be selected depending on the pattern of the lines of weakness 10. In the example illustrated in FIG. 3, the pattern is generally similar to a fish net so that facets 12 have a generally ellipsoidal shape. However, many other different patterns can be envisaged, as illustrated in FIGS. 6, 7 and 8. Referring to FIG. 6A-E, the facets for a particular blank may be of identical shape arrayed over the entire surface of the blank 9. Alternatively, as illustrated in FIG. 7, the first array 13 may extend over the major part of the blank and a second array 14 which may include facets of a different shape to those in the first array 13, may be configured over the mouthpiece end of the blank 9. The facets 12 may have a closed perimeter which may be curved or polyogonal in shape, or the facets may have an open shape such as parallel strips extending between spaced, parallel lines of weakness, for example extending longitudinally of the cigarette as illustrated in array 14 in FIG. 7 or in a spiral pattern (not shown).

Also, as illustrated in FIG. 8, the mouthpiece end array 14 of facets may be omitted.

Figure 9:
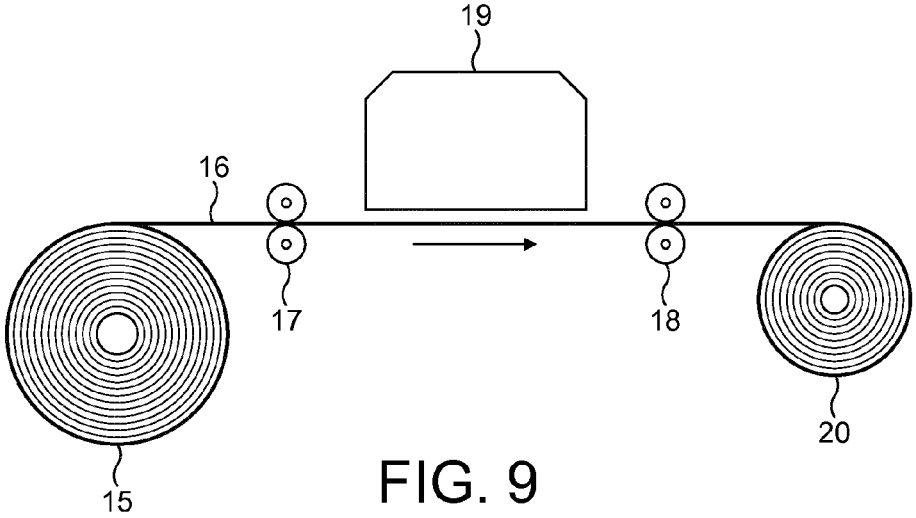
FIG. 9 is a schematic illustration of apparatus for forming the wrapper.
Figure 10:
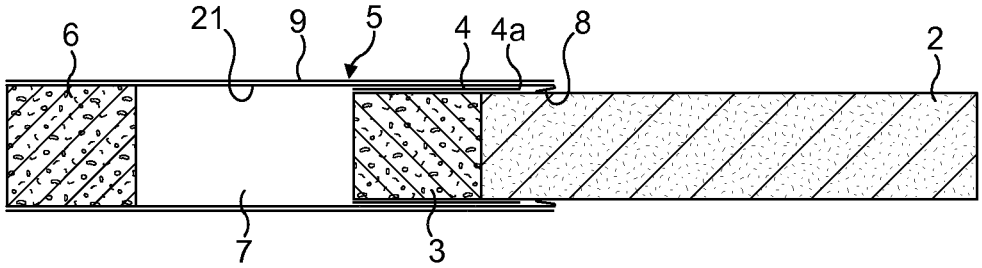
FIG. 10 is a longitudinal sectional view of a further example of an extendible cigarette in an unextended configuration.
Figure 11:
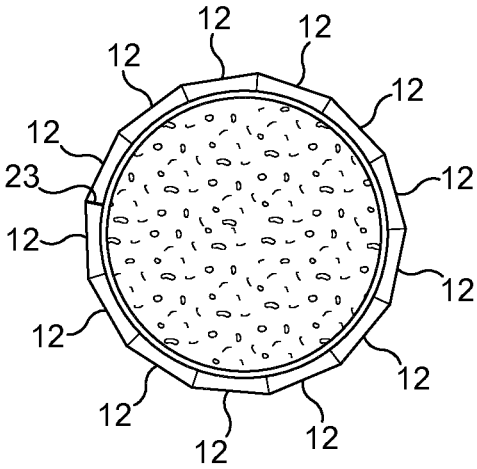
FIG. 11 is a mouth end view of the cigarette shown in FIG. 10.
Figure 12:
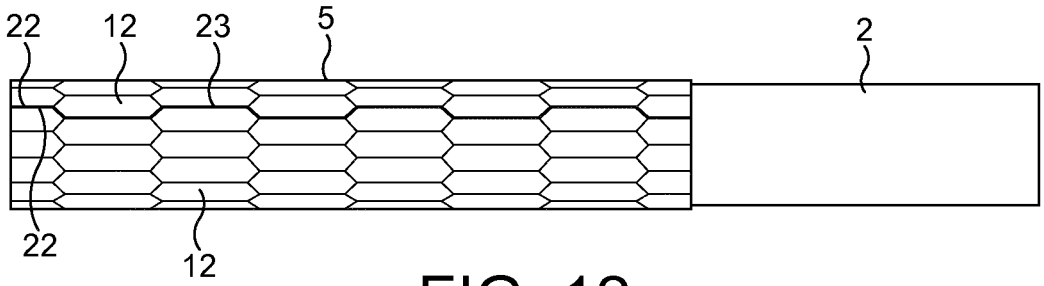
FIG. 12 is a side view of the cigarette shown in FIGS. 10 and 11.

FIG. 9 is a schematic illustration of apparatus for forming sheet material for use in the blanks 9. In this example the A roll 15 of paper or like sheet material is supplied as a continuous web 16 by means of supply rollers 17, 18 through a station 19 where the lines of strength discontinuity are formed. The station 19 may include one or more lasers that produce the lines of weakness 10 across the web 16. Alternatively the station 19 may include blades to cut the paper web 16 on one or both sides to form the lines 10, or an arrangement to crease the paper web to form the lines of weakness. The web 16 after leaving the station 19 may be fed into a take up roll 20 which is then taken to a cigarette making machine for incorporation into cigarettes. Thus the paper is prepared off-line from the cigarette making machine in a preparatory process. By way of background, an example of how the web 16 may be incorporated into a process for forming the telescopic cigarette is described in our PCT/GB2011/050499. Alternatively, the web 16 and the station 19 may be provided on-line at the cigarette making machine for forming the lines of weakness in the web just before it is supplied into the making machine.

Whether prepared on or off-line from the cigarette making machine, the web 16 may also be printed or embossed with logostyle or other information, and the printing or embossing may be performed in a predetermined registry with the pattern of facets 12, for example so that the printing or embossing is configured within individual ones of the facets.

Another example of extendible cigarette is illustrated in FIGS. 10 to 13. In this example the sleeve 5, instead of being made solely of the facetted blank 9 as in FIGS. 1 to 4, also includes an underlying support layer 21 to which the blank 9 may be affixed by gluing or other suitable means evident to those skilled in the art. The support layer 21 may comprise a rectangular, rolled blank of sheet material such as paper and is formed with the re-entrant lip 8 so as to limit the extension of the tobacco rod 2 along the sleeve 5 by engaging the edge 4*a* of tipping paper 4 which holds the filter 3 on the end of the tobacco rod 2, in a similar fashion to the lip 8 described with reference to FIGS. 1 to 4. The support layer 21 is glued to the filter 6.

In the example shown in FIGS. 10 to 13, the blank 9 is formed with a regular pattern of facets 12 that comprise irregular hexagons that resemble a fish net in a similar pattern to that shown in FIG. 1. However, unlike FIG. 1, the blank 9 shown in FIG. 10 has longitudinal side edges 22, one of which is shown more clearly in FIG. 13, which follow the edges of the facets 12 so that they can be arranged in a butt joint 23 illustrated in Figures n and 12, with the advantage that the pattern of facets 12 can run continuously around the exterior of the sleeve without a discontinuity that can be felt in the finger of the hand or which is visible to the user.

Figure 13:
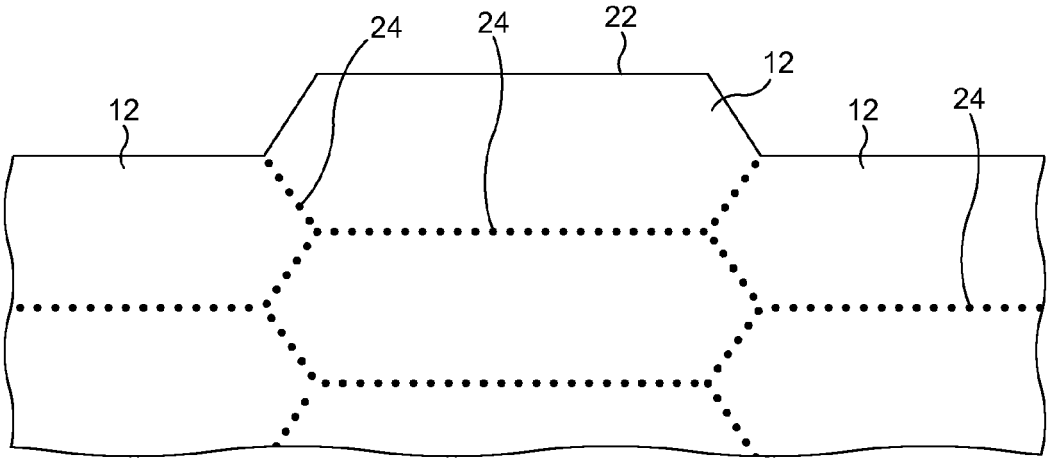
FIG. 13 is an enlarged view of a portion of a wrapper in which lines of weakness have been formed by pin embossing.

In the example shown in FIG. 13, the lines of weakness 10 are formed by pin embossing, which produces a line of pin pricks 24 around the perimeter of the facets. The pin pricks 24 can be formed using a roller that has a pattern of pins around its periphery, which is included in the station 19 shown in FIG. 9, so that upon rotation of the roller in engagement with the web 16, the pattern of pin pricks shown in FIG. 13 is produced.

Many modifications and variations to the described smoking article and its components fall within the scope of the invention. For example, the wrapper web 16, after formation of the lines of weakness, may be used as a wrapper in a conventional cigarette for the tobacco rod and/or for use as tipping paper to attach a filter to a tobacco rod.

Also, the lines of weakness 10 can be formed on the outside of the tubular sleeve 5 to achieve the visually discernable facets 12. The production of the lines of strength discontinuity may involve burning to produce a discernable pattern around the perimeters of the facets to enhance the visual effect. For example the cutting may involve burning. Also, the burning can mimic printing to permit logos and the like to be applied to the tubular sleeve 5.

For the lighter weight papers, i.e. 20 gsm to 40 gsm when used as the web 16, a structural coating such as a varnish can be applied e.g. by printing onto the paper to rigidify the paper and thereby define the facets. This could be printed on the inside or outside of the tube 5 depending on the finish required. Alternatively, the varnish can be printed in lines to form borders around the facets.

Also, the lines of strength discontinuity need not be lines of weakness and can be lines of strength formed for example by printing patterns of starch onto the sheet material in order to produce local stiffening.

As used herein, the term "smoking article" includes smokeable products such as cigarettes, cigars and cigarillos whether based on tobacco, tobacco derivatives, expanded tobacco, reconstituted tobacco or tobacco substitutes and also heat-not-burn products.

In order to address various issues and advance the art, the entirety of this disclosure shows by way of illustration various embodiments in which the claimed invention(s) may be practiced and provide for superior wrappers and smoking articles and methods of making them. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilized and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. A smoking article component, comprising: a curved sheet wrapper that includes a plurality of lines of strength discontinuity configured such that the wrapper presents visually discernable facets between the lines of strength discontinuity, the facets being substantially planar, wherein the plurality of lines of strength discontinuity comprise pin embossed lines of weakness, creased lines of weakness, or lines of partial cuts into the thickness of the wrapper.

2. The smoking article component according to claim 1, wherein the partial cuts are on a side of the wrapper that forms an inner surface of the wrapper.

3. The smoking article component according to claim 1, wherein the partial cuts are partial laser cuts.

4. The smoking article component according to claim 1, the wrapper further including a coating thereon.

5. The smoking article component according to claim 4 wherein the coating comprises a varnish.

6. The smoking article component according to claim 1, wherein the lines of strength discontinuity define an array of the facets over the wrapper.

7. The smoking article component according to claim 1, wherein the lines of strength discontinuity intersect or merge, defining facets having a closed shape.

8. The smoking article component according to claim 1, wherein a plurality of the facets are of the same shape and disposed in an array.

9. The smoking article component according to claim 8, wherein facets of a first shape are arranged in a first array in a first portion of the wrapper and facets of a second shape different from the first shape are arranged in a second array in a second portion of the wrapper.

10. The smoking article component according to claim 9 wherein opposite edges of the wrapper have a shape defined by the edges of the facets such that when wrapped to abut one another, the opposite edges of the sheet form a butt joint against one another such that the array extends across the butt joint.

11. The smoking article component according to claim 1, wherein the wrapper is disposed on an underlying support layer.

12. The smoking article component according to claim 1, wherein the wrapper is disposed in a tubular configuration.

13. The smoking article component according to claim 1, the wrapper further including longitudinal side edges, the wrapper configured such that, when joined, the longitudinal side edges of the wrapper form a butt joint.

14. The smoking article component according to claim 1, further comprising: a curved surface around which the wrapper is provided, wherein the facets have a curvature that differs from that of the curved surface.

15. The smoking article component according to claim 1, further comprising: at least one of a filter having a curved surface and a tobacco rod having a curved surface, the curved surface(s) wrapped with the wrapper.

16. The smoking article component according to claim 15, wherein at least some of the plurality of lines of strength discontinuity extend longitudinally of the filter or tobacco rod.

17. A smoking article comprising: a smoking article component, the smoking article component including:

a curved sheet wrapper having a plurality of lines of strength discontinuity configured such that the wrapper presents visually discernable facets between the lines of strength discontinuity, the facets being substantially planar, wherein the plurality of lines of strength discontinuity comprise pin embossed lines, creased lines, or partial cuts into the thickness of the wrapper; and at least one of a filter having a curved surface and a tobacco rod having a curved surface, the curved surface(s) wrapped with the wrapper.

18. The smoking article according to claim 17, comprising a rod of smokeable material, a first filter attached to the rod of smokeable material, and a second filter, said wrapper being wrapped around and attached to the second filter to form a tube in which the first filter and rod of smokeable material are slidably received.

19. The smoking article according to claim 18, wherein the first filter is attached to the rod of smokeable material by a circumferential tipping paper, and wherein the wrapper has a re-entrant flap configured to abut the tipping paper, thereby preventing the rod from being withdrawn out of the tube.

20. A wrapper configured to be wrapped around a smoking article component, the wrapper comprising a plurality of lines of strength discontinuity configured such that when wrapped around a curved surface, the wrapper presents visually discernable facets between the lines of strength discontinuity, the facets being substantially planar, wherein the plurality of lines of strength discontinuity comprise pin embossed lines, creased lines, or partial cuts into the thickness of the wrapper.

21. The wrapper according to claim 20, wherein the wrapper is configured such that when the wrapper is wrapped around a curved surface, the facets are of a different curvature than that of the curved surface.

22. The wrapper according to claim 20, having a generally rectangular shape and being configured to be formed into a tube that includes a re-entrant flap at one end thereof.

* * * * *